US005436101A

United States Patent [19]

Fender et al.

[11] Patent Number: 5,436,101

[45] Date of Patent: Jul. 25, 1995

[54] NEGATIVE CHARGING SELENIUM PHOTORECEPTOR

[75] Inventors: William D. Fender; Eddie M. Zanrosso, both of Pasadena, Calif.

[73] Assignee: Xerox Corporation, Stamford, Conn.

[21] Appl. No.: 109,564

[22] Filed: Aug. 20, 1993

[51] Int. Cl.[6] ..... G03G 5/08

[52] U.S. Cl. ..... 430/65; 430/84; 430/95

[58] Field of Search ..... 430/65, 84, 85, 86, 430/95

[56] References Cited

U.S. PATENT DOCUMENTS

| | | | |
|---|---|---|---|
| 2,803,542 | 5/1957 | Ullrich | 430/85 |
| 3,837,849 | 9/1974 | Ciuttini | 430/85 |
| 3,901,703 | 8/1975 | Baum | 430/85 |

*Primary Examiner*—John Goodrow
*Attorney, Agent, or Firm*—Robert Cunha

[57] ABSTRACT

An x-ray photoreceptor for use in a xerographic system having a high arsenic layer 5 to 40 microns in thickness between the substrate and the selenium layer for trapping positive charge injected from the interface. Since this positive charge otherwise tends to discharge a negatively charged plate, the provision of this trapping layer will allow the plate to be used for either positive or negative charging.

4 Claims, 3 Drawing Sheets

NEGATIVE CHARGING SELENIUM PHOTORECEPTOR

BACKGROUND OF THE INVENTION

An x-ray xerographic photoreceptor having a high arsenic doped selenium alloy layer near the aluminum or transparent substrate interface to provide a hole blocking layer for negative charging of the photoreceptor.

When a negative charge is placed on the top surface of a photoreceptor and the substrate acquires a positive counter-charge, positive charges or holes, enter the selenium layer from the substrate. In conventional paper transfer systems, negative charging commonly occurs when the photoreceptor passes under a negative corotron at the image transfer station. Negative charging at transfer is described in U.S. Pat. No. 5,023,661 which is incorporated herein by reference.

FIG. 1A of the cited patent shows the result of a transfer corotron charging the top surface of the photoreceptor to a negative potential. The substrate is held at ground potential so that an electrostatic field is developed between the photoreceptor substrate and the top surface overcoating in response to this applied field, holes migrate upward from the substrate toward the amorphous selenium layer. If the surface of the selenium layer which is in contact with the substrate has a selenium crystallite defect then holes will enter the selenium at this site and will migrate under the influence of the field into the upper-most portion of the selenium photoconductor. These concentrations of migrated charge at points over crystallite defects ultimately generate artifacts in subsequent image cycles. The solution proposed by the referenced patent is to pre-charge the photoreceptor to remove these positive charge concentrations immediately before the beginning of a standard image cycle.

The cited reference also shows that the top surface of the selenium bulk layer has an arsenic-rich layer to increase its hardness and to thereby prevent scratching and surface crystallization. The photoreceptor is operable and durable without this top surface layer. However, if the manufacturer prefers, he has the option of applying a protective layer to the photoreceptor for additional surface durability. The arsenic increases the hardness of the selenium by raising the alloy viscosity, glass transition temperature and boiling points.

Because the positive charges tend to concentrate above crystallite sites creating defects, two other commonly assigned U.S. Pat. No. 5,300,784 and 5.320,927, describing how the formation of these crystallites can be prevented, are incorporated herein by reference. During the manufacture of xerographic photoreceptors, the selenium-arsenic alloy is retained in a crucible array in the vacuum deposition chamber and is evaporated under vacuum onto the substrate in a molten liquid form. Later, as the selenium cools and solidifies, the selenium at the substrate interface may crystallize if insufficient arsenic is present. The arsenic tends to break up the regularity of the material and increases its viscosity at a given temperature making the formation of crystallites less likely. Because arsenic tends to fractionate last from an arsenic-selenium alloy during vacuum deposition, it is difficult to achieve high arsenic concentration in the initially deposited layer as desired. This initial layer is therefore deposited from a separate crucible array in a thicknes range of 0.05 to 5 microns. Minimization of crystallites prevents local concentrations of positive charge and thereby minimizes the appearance of point discharge artifacts under negative charging conditions. This intermediate layer is commonly not used in most production operations but may be used at the manufacturer's discretion, particularly in instances where interface-related artifacts pose a problem. When this intermediate layer is not used, the bulk layer is deposited directly on the substrate.

Even in the absence of interface crystallites, positive charge tends to inject into the selenium layer more or less uniformly contributing to rapid dark decay thereby preventing the retention of a negative surface charge.

In a system that utilizes positive surface charging, the substrate is negative with respect to the selenium top surface and holes, therefore, are not generated at the substrate interface during the charging cycle. The dark decay is low and the photoreceptor retains its initial surface charge and resultant initial electrostratic field. This internal field is essential for the generation and transport of charge during imaging. During negative transfer following exposure, the top surface negative potential is small, its application brief so that the presence of holes at the substrate interface is not significant. However, if the initial surface charge is negative, the generation of holes from the substrate will discharge the negative charge at the top surface creating dark decay and rendering the plate unsuitable for exposure. For this reason, selenium xerographic copier systems use positive charging and rely on the migration of positive charge during exposure to form an image.

For medical imaging, which includes mammography as well as radiography, there is a need to expose the patient to the lowest possible x-ray dose. Patient-dose minimization, moreover, is essential regardless of whether the development mode utilizes conventional powder, liquid or digital technologies. In a line copier, the visible light radiation does not penetrate beyond a few microns of selenium and therefore, only holes migrate down from the top surface to the substrate to discharge the photoreceptor Therefore, the selenium layer need not be so thick as in medical imaging, fifty to sixty microns being typical for copier applications. However, for medical imaging, x-rays penetrate to a greater depth. Therefore, to capture as many radiation quanta as possible, x-ray photoreceptors are thicker; 150 to 450 microns is a typical thickness range. In medical photoreceptors, electron-hole pairs are created throughout the bulk of the material. Therefore, to obtain the greatest electrostatic response from a unit of x-radiation, the migration of both electrons and holes is used to discharge the photoreceptor.

In certain powder, liquid and digital imaging systems configuration design requirements arise in which it is advantageous to be able to charge a plate negatively or positively while preventing the migration of holes from discharging the plate before it can be used to generate an image.

SUMMARY OF THE INVENTION

In a medical photoreceptor it is common to add a modest amount of arsenic, 0.01 to 1 percent, to the photoreceptor bulk-layer of selenium to increase its hardness and durability. However, even low concentrations of arsenic will trap positive charge. Therefore chlorine, which tends to trap negative charge, is added in an effort to bring the selenium layer back to an electrically neutral state. The electrons and holes thus trapped by the arsenic and chlorine dopants contribute to ghosting and dark-decay on subsequent recharging thus necessitating increased thermal relaxation between image cycles in order to empty the trapped charge. The resulting empty trap sites also contribute to reduced x-ray sensitivity as they trap x-ray photogenerated charge thereby preventing full carrier movement to the oppositely charged photoconductor electrode.

This invention takes advantage of the hole trapping properties of arsenic by providing a layer of arsenic-rich selenium between the selenium bulk and the substrate to trap the positive charge which otherwise would cause the dark decay of a negatively charged photoreceptor.

The resultant x-ray photoreceptor has four distinct layers of arsenic-doped selenium which serve the following functions. First, starting from the bottom, the previously described bottom-surface layer prevents crystallite formation and crystallite growth thereby preventing the injection of concentrations of holes which would drift upward through the bulk creating point discharge defect sites. This first layer thereby minimizes the resultant image artifact level.

The second layer, the proposed blocking layer described herein, provides a hole trapping barrier, which functions in the following manner. At a low arsenic-selenium alloy surface, which is in contact with a positively charged substrate, an occasional atom will loose its electron to the substrate and thereby will acquire a net positive charge. At some later time the positive atom will randomly pull in an electron from a neighboring selenium atom, and at that point the new atom will become the one with the positive charge. In this way, the positive charge will migrate through the selenium bulk. Hole motion, in effect is the result of electron migration at the atomic valence-band energy level. However, the electron of an arsenic atom is held more loosely than one of selenium, and therefore, when a hole is in the vicinity of an arsenic atom, the atom will lose its electron and thereby trap the positive charge. The possibility of the migration continuing is unlikely due to the weaker affinity for electrons of the arsenic atom. The arsenic thereby has become a hole trap.

At the interface between low-arsenic selenium and a substrate, the selenium has one loosely bound electron which it can give up. It therefore is possible for positive, but not for negative, charge to be induced in the selenium at the substrate. However, with the trapping layer in place, the migration of positive charges also is prevented. The resultant photoreceptor now is operationally symmetrical so that not only can it be charged positively, it can rely on the trapping of holes at the high arsenic interface to allow negative charging as well.

This high-arsenic doped selenium alloy layer under the bulk selenium may be deposited on a standard aluminum substrate or on a transparent substrate coated with such transparent conductive coatings as NESA or ITO (indium tin oxide). The photoreceptor may be used in a variety of applications, such as line copiers or conventional xeroradiographic powder, liquid or digital development systems, wherever a bi-polar or negatively charging photo-conductor would be desired.

The bulk-selenium or third layer, which must operate as pure selenium to minimize trapping of holes and free electrons may be doped with a low level of arsenic to increase hardness and durability, but will have to be balanced with an offsetting concentration of chlorine. Typically the arsenic concentration of this bulk layer will range from 0.01 to 1 percent while the chlorine concentration will range from 3 to 20 parts per million.

The fourth and final selenium layer is a top surface coating which is doped with a high concentration of arsenic to prevent scratching and crystallite formation and also will serve as a hole barrier during positive charging.

A final protective polymer overcoating layer may be applied over this four layer selenium-arsenic alloy structure for added protection against moisture and other chemically reactive airborne contaminants as described in the cited reference patents. However, photoreceptors are more commonly manufactured without one, unless the intended environment is particularly caustic.

A difference between the hole-trapping of the second layer and the previously described effect of preventing the formation of interface crystallites is that the latter tends to be a surface effect. Crystallites occur within a few microns of the surface boundary between the substrate and the selenium. Therefore, the thickness of this boundary layer of doped selenium is small, 0.05 to 5 microns. The purpose of the second layer, however, is to trap the charge before it can get into the bulk selenium layer. If the trapping layer is too thin, holes may escape into the bulk layer without encountering an arsenic atom. The result is that the trapping layer must be of sufficient thickness to guarantee that the charge, in fact, will be trapped but not so thick as to cause excessive residual potential after x-ray discharge. It has been found that the optimal thickness for this effect is 5 to 40 microns, ranging from 1.0 to 33% by weight mean arsenic concentration. This high arsenic trapping layer is followed by a conventional deposition of 150 to 450 microns of amorphous chlorine-arsenic arsenic doped selenium to provide the bulk x-ray absorption and carrier transport layer of the photoconductor. The fourth layer of high-arsenic material may be deposited for hardening of the top surface or to make the photoconductor bi-polar so that it may be positively charged with the top layer serving as the hole trapping layer. Alternately, the top high-arsenic layer may be omitted and replaced by a high-arsenic layer which is fractionated directly from the selenium-arsenic alloy bulk layer. This latter alternative avoids the use of a third set of crucibles for a separate high-arsenic top-layer deposition.

BRIEF DESCRIPTION OF DRAWINGS AND GRAPHS

DETAILED DESCRIPTION OF THE INVENTION

Figure 1:
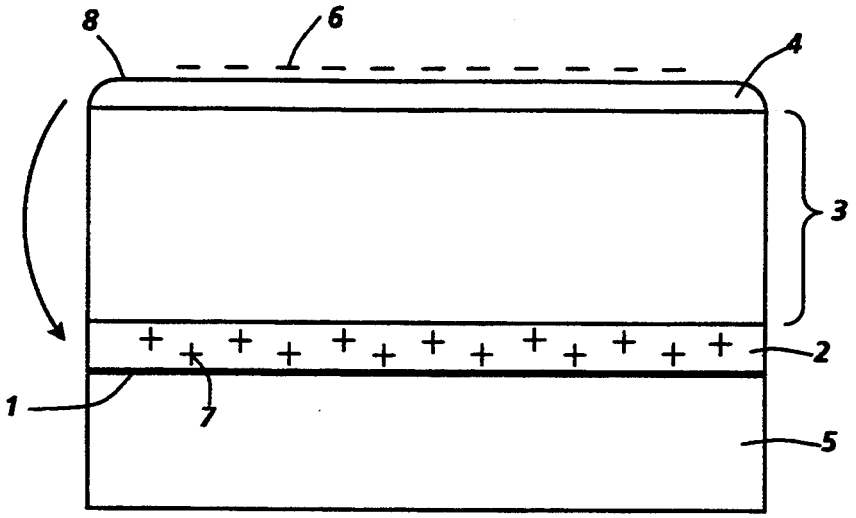
FIG. 1 is a cross sectional view of the photoreceptor.

FIG. 1 is a cross sectional view of the photoreceptor comprising a bottom substrate (5) and a bulk layer (3) of selenium-arsenic alloy. Above the bulk layer is a top high arsenic layer (4) which gives a greater degree of hardness to the top surface. The proposed hole blocking layer (2) of high arsenic selenium is shown between the substrate (5) and the bulk layer (3) which under negative charging traps the positive counter-charge. An interface crystallite retardation layer (1) is shown between the substrate and hole blocking layer to minimize interface generated artifacts. The cross-section is shown in a negatively charged state with negatively charged ions (6) on the top surface and trapped positive charges (7) trapped in the blocking layer (2). An organic overcoating (8) is shown on top of the top high-arsenic layer (4).

Because of the symmetrical nature of selenium layers (2) and (4) in providing hole barriers, this photoreceptor can be charged either positively or negatively, a feature that is lacking in state-of-the-art selenium photoreceptors. Without the proposed blocking layer (2), under a negative surface charge, positive charge from the substrate would, over time, inject and migrate upward to the top surface neutralizing the negative surface charge. The resultant discharge or dark decay, so called because it occurs in the absence of radiation or visible light, would render the photoreceptor unsuitable for x-ray exposure.

Figure 2:
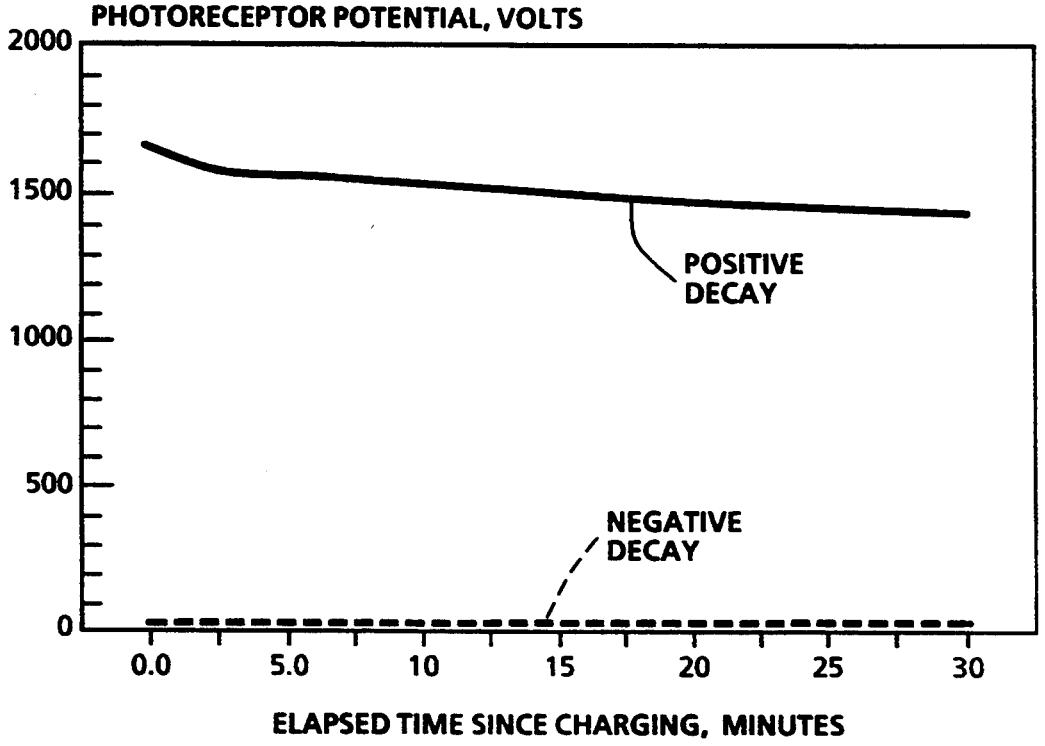
FIG. 2 (Prior Art)
FIG. 2 is a graph illustrating the difference between the dark decay rates of a typical state-of-the-art plate that is either positively or negatively charged.

FIG. 2 shows the difference between the dark decay rates of a typical prior-art photoreceptor that is either positively or negatively charged. A positively charged plate has an acceptable dark decay rate. However, as shown by the dotted line at the bottom of the graph, the plate can not be charged in the negative direction. Under negative charging, the dark decay rate is extremely high. Thus the typical selenium xerographic process uses a positively charged photoreceptor.

Figure 3:
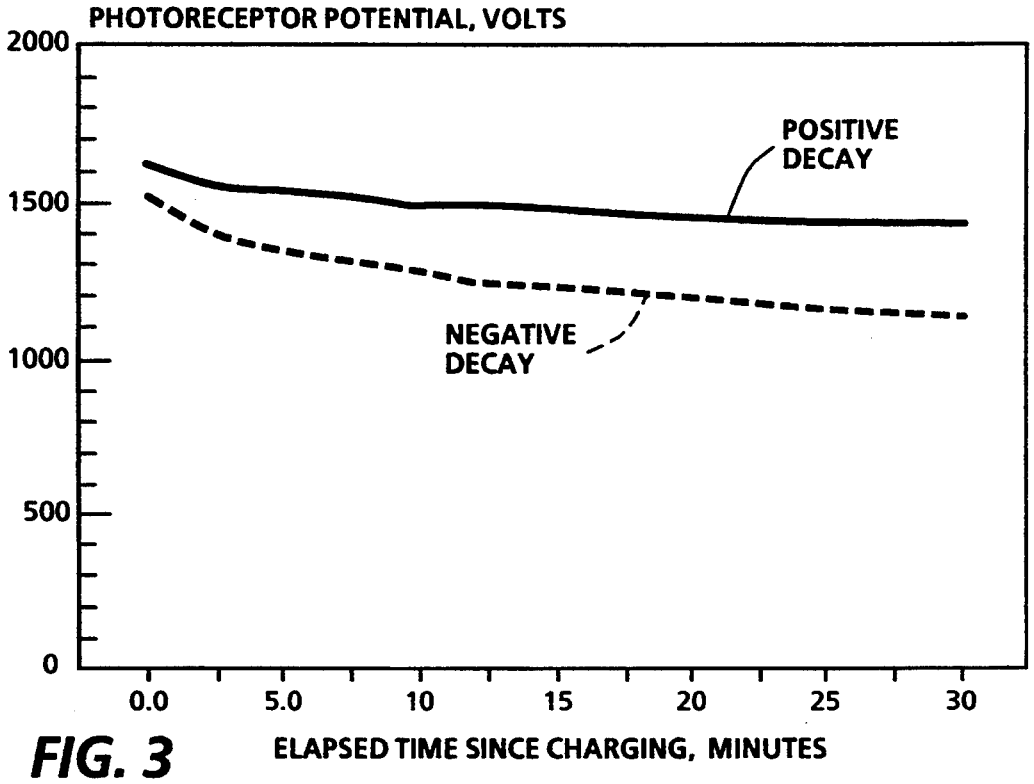
FIG. 3 is a graph of the difference between the dark decay rates of a plate having the proposed blocking layer that is either positively or negatively charged.

FIG. 3 shows the difference between the dark decay rates of a photoreceptor having a blocking layer, as described herein, that is either positively or negatively charged. Under negative charging the plate dark decays slightly faster than under positive charging. Nevertheless, both rates are acceptably low.

Figure 4:
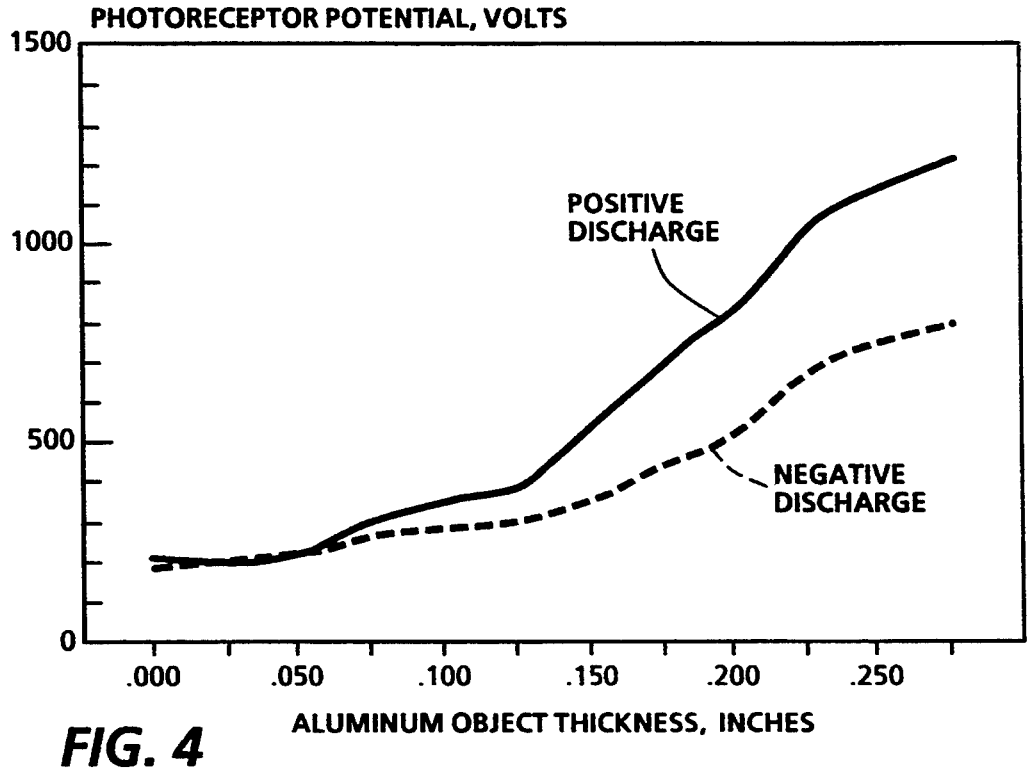
FIG. 4 is a graph of the residual surface potential remaining on the plate of FIG. 3 after a unit of x-ray radiation for a range of target thicknesses.

FIG. 4 shows the residual image potential on the photoreceptor of FIG. 3 after a unit of x-ray radiation for a range of target thicknesses. In this case the target is a sheet of aluminum up to 0.40 inches in thickness plotted on the horizontal axis. The comparison is between charging a plate either positively or negatively, fabricated according to the process herein described. One sees that, for a given target thickness, the negative charge followed by x-ray exposure results in a greater degree of plate discharge than in the case of positive charging and discharge. That is to say, charging the plate negatively results in greater discharge during the imaging cycle. This effect occurs because an increased fraction of x-ray energy is absorbed near the photoreceptor surface in comparison to the substrate interface. As a result of this asymmetric exponential-like x-ray absorption profile, the downward moving carrier, or electron in the case of negative charging, will provide the greater degree of discharge. One concludes from this result that the electron, at least for this photoreceptor manufacturing process, is able to travel further on the average than the hole.

Figure 5:
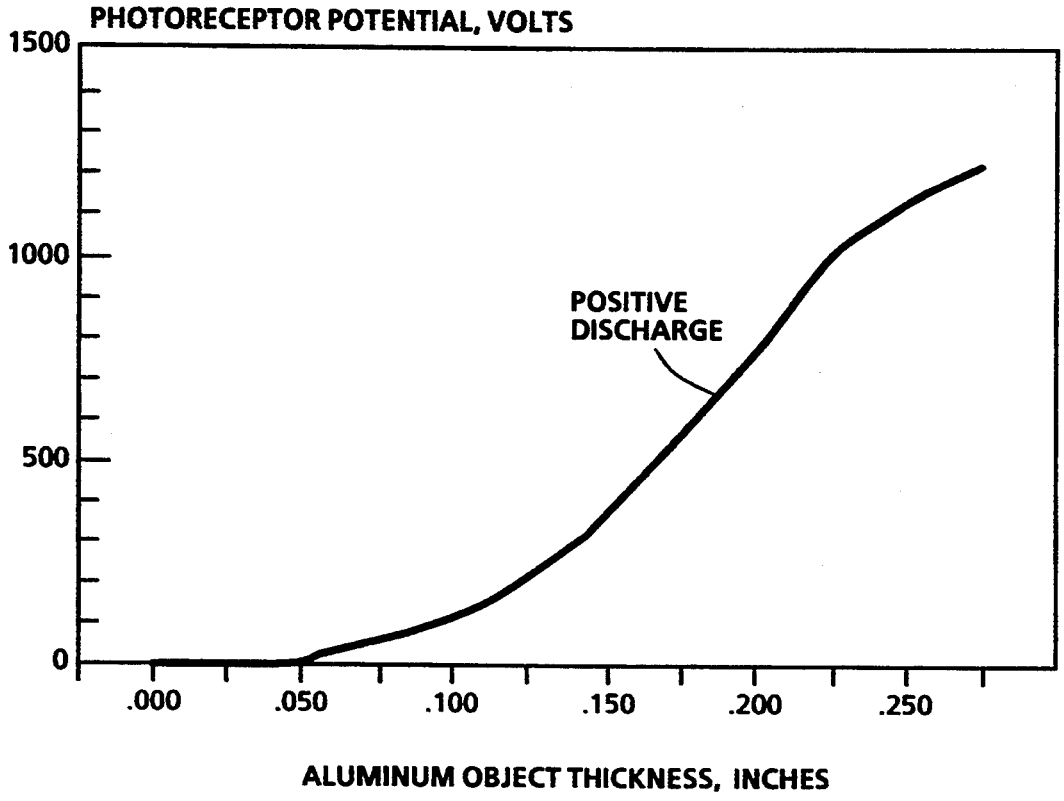
FIG. 5 (Prior Art)
FIG. 5 is a graph of the residual surface potential remaining after x-ray exposure on the plate of FIG. 2 that is positively charged.

For completeness, FIG. 5 shows the comparable x-ray discharge of a prior-art photoreceptor without the proposed interface trapping layer. One difference between the two figures is that in FIG. 5 the photoreceptor is discharged to nearly zero at small target thicknesses while in FIG. 4 the plate is discharged to approximately 200 volts. This inability to completely discharge is due to the hole trapping properties of the added blocking layer and may be adjusted by varying the blocking layer thickness within the range specified depending on the desired negative charging potential.

While the invention has been described with reference to a specific embodiment, it will be understood by those skilled in the art that various changes may be made and equivalents may be substituted for elements thereof without departing from the true spirit and scope of the invention. Moreover, many modifications may be made without departing from the essential teachings of the invention.

We claim:

1. An x-ray selenium protoreceptor comprising:
a conductive substrate having a surface,
a semiconductor selenium bulk layer 150 to 450 microns in thickness having an arsenic concentration of 0.01 to 1% by weight and a chlorine concentration of 3 to 20 parts per million, and having a surface adjacent to said substrate and an other surface,
a first layer of selenium arsenic alloy 0.1 to 33% arsenic by weight and 0.05 to 5 microns in thickness in contact with said substrate surface for retarding the formation of artifact producing selenium crystallites between said substrate surface and said first layer, and
a second layer of selenium arsenic alloy 0.1 to 33% arsenic by weight 5 to 40 microns in thickness between, and in contact with, said first and bulk layers for trapping positive charges when the bulk layer is negatively charged with respect to the substrate.

2. The photoreceptor of claim 1 wherein said substrate is transparent.

3. The photoreceptor of claim 1 wherein said substrate is opaque.

4. The photoreceptor of claim 1 further comprising a third layer of arsenic rich selenium 0.1 to 33% arsenic by weight doped with 3 to 20 parts per million chlorine 5 to 40 microns in thickness on the other surface of said bulk layer to trap positive charges when the bulk layer is positively charged with respect to the substrate, and to retard the formation of artifact-producing selenium crystallites at the other bulk layer surface.

* * * * *